US008886090B2

(12) United States Patent
Kawata et al.

(10) Patent No.: US 8,886,090 B2
(45) Date of Patent: Nov. 11, 2014

(54) FIXING DEVICE INCLUDING AN ENGAGEMENT-DISENGAGEMENT UNIT AND IMAGE FORMING APPARATUS EQUIPPED WITH THE FIXING DEVICE

(71) Applicants: Teppei Kawata, Kanagawa (JP); Kenji Ishii, Kanagawa (JP); Tadashi Ogawa, Tokyo (JP); Arinobu Yoshiura, Kanagawa (JP); Toshihiko Shimokawa, Kanagawa (JP); Kensuke Yamaji, Kanagawa (JP); Yuji Arai, Kanagawa (JP); Yoshiki Yamaguchi, Kanagwa (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP); Masaaki Yoshikawa, Tokyo (JP); Takayuki Seki, Kanagawa (JP); Shuntaroh Tamaki, Kanagawa (JP); Kazuya Saito, Kanagawa (JP); Yutaka Ikebuchi, Kanagawa (JP)

(72) Inventors: Teppei Kawata, Kanagawa (JP); Kenji Ishii, Kanagawa (JP); Tadashi Ogawa, Tokyo (JP); Arinobu Yoshiura, Kanagawa (JP); Toshihiko Shimokawa, Kanagawa (JP); Kensuke Yamaji, Kanagawa (JP); Yuji Arai, Kanagawa (JP); Yoshiki Yamaguchi, Kanagwa (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP); Masaaki Yoshikawa, Tokyo (JP); Takayuki Seki, Kanagawa (JP); Shuntaroh Tamaki, Kanagawa (JP); Kazuya Saito, Kanagawa (JP); Yutaka Ikebuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 45 days.

(21) Appl. No.: 13/710,899

(22) Filed: Dec. 11, 2012

(65) Prior Publication Data

US 2013/0188991 A1 Jul. 25, 2013

(30) Foreign Application Priority Data

Jan. 23, 2012 (JP) ..... 2012-010862
Oct. 31, 2012 (JP) ..... 2012-241047

(51) Int. Cl.
*G03G 15/20* (2006.01)

(52) U.S. Cl.
CPC ..... *G03G 15/2085* (2013.01); *G03G 15/205* (2013.01); *G03G 15/2053* (2013.01); *G03G 2215/2035* (2013.01)
USPC ..... 399/122

(58) Field of Classification Search
USPC ..... 399/122
See application file for complete search history.

(56) References Cited

U.S. PATENT DOCUMENTS 7,526,242 B2 * 4/2009 Takagaki et al. ..... 399/307
8,478,176 B2 * 7/2013 Tagami ..... 399/322

(Continued)

FOREIGN PATENT DOCUMENTS

JP 7-064422 3/1995
JP 2004-294554 10/2004

(Continued)

OTHER PUBLICATIONS

U.S. Appl. No. 13/557,841, filed Jul. 25, 2012, Toshihiko Shimokawa, et al.

*Primary Examiner* — G. M. Hyder
(74) *Attorney, Agent, or Firm* — Harness, Dickey & Pierce, P.L.C.

(57) ABSTRACT

A fixing device comprises a rotatable fixing member to heat a side of a recording medium bearing an unfixed image; a heat source to heat the rotatable fixing member; a rotatable pressing member disposed opposite the fixing member to press against an outer side of the fixing member; a housing to accommodate the fixing member and the pressing member; a conveyance path defined internally within the fixing device to convey a recording medium therethrough and between the fixing member and the pressing member, and a shutter actuator to move the shutter to open and close the conveyance path. The housing holds the shutter and the shutter actuator.

20 Claims, 8 Drawing Sheets

(56) References Cited

U.S. PATENT DOCUMENTS

2003/0165348 A1 9/2003 Amita et al.
2004/0013453 A1 1/2004 Shinshi et al.
2004/0179875 A1 9/2004 Iwata et al.
2005/0074251 A1 4/2005 Katoh et al.
2005/0129432 A1 6/2005 Sato et al.
2005/0163543 A1 7/2005 Satoh et al.
2006/0029411 A1 2/2006 Ishii et al.
2006/0116230 A1 6/2006 Satoh et al.
2006/0165429 A1 7/2006 Satoh et al.
2006/0165443 A1 7/2006 Yoshinaga et al.
2006/0177232 A1 8/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi
2007/0059011 A1 3/2007 Seo et al.
2007/0166083 A1 7/2007 Satoh et al.
2007/0212089 A1 9/2007 Seo et al.
2007/0242988 A1 10/2007 Seo et al.
2007/0280754 A1 12/2007 Ogawa et al.
2007/0292175 A1 12/2007 Shinshi
2008/0025772 A1 1/2008 Seo et al.
2008/0025773 A1 1/2008 Ito et al.
2008/0044196 A1 2/2008 Seo et al.
2008/0219721 A1 9/2008 Ito et al.
2008/0226326 A1 9/2008 Seo et al.
2008/0232873 A1 9/2008 Ueno et al.
2008/0317532 A1 12/2008 Ehara et al.
2009/0123201 A1 5/2009 Ehara et al.
2009/0148204 A1 6/2009 Yoshinaga et al.
2010/0074667 A1 3/2010 Ehara et al.
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176822 A1 7/2011 Ishii et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0236070 A1* 9/2011 Mizuno et al. ..... 399/122
2011/0274453 A1 11/2011 Shimokawa et al.
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.

FOREIGN PATENT DOCUMENTS

JP 2005-250326 9/2005
JP 2006-133318 5/2006
JP 2006-322761 11/2006
JP 2007-233011 9/2007
JP 2007-295433 11/2007
JP 2007-334205 12/2007
JP 2008-072391 3/2008
JP 2009237079 A * 10/2009

* cited by examiner

FIXING DEVICE INCLUDING AN ENGAGEMENT-DISENGAGEMENT UNIT AND IMAGE FORMING APPARATUS EQUIPPED WITH THE FIXING DEVICE

CROSS-REFERENCE TO RELATED APPLICATIONS

This patent application is based on and claims priority pursuant to 35 U.S.C. §119 to Japanese Patent Application Nos. 2012-010862 and 2012-241047, filed on Jan. 23, 2012 and Oct. 31, 2012, respectively, in the Japanese Patent Office, the entire disclosures of which are hereby incorporated by reference herein.

BACKGROUND OF THE INVENTION

1. Field of the Invention

This invention relates to a fixing device and an image forming apparatus equipped with the fixing device.

2. Description of the Related Art

As a fixing device used in various types of image forming apparatuses, such as a copier, a printer, a facsimile machine, a multifunction device, etc., that which employs a thin fixing belt consisting of a metal substrate and an elastic rubber layer or the like is well known. Such a thin fixing belt decreases heat capacity, and accordingly the amount of energy needed to heat the fixing belt is significantly reduced thereby shortening both a warm-up time period (e.g. reload temperature) when a power is turn on or the like and a time to first print (i.e., a time period after receiving a print request until sheet ejection through preparation and conducting printing).

Conventionally, as disclosed in Japanese Patent Application Publication No. 2007-334205 (JP-2007-334205-A), a fixing device employs an endless belt (i.e., a fixing belt), a pipe-shaped metal heat conductor disposed inside the loop formed by the endless belt, a heat source in the metal heat conductor, and a pressing roller contacting the metal heat conductor via the endless belt forming a nip N thereon. The endless belt is rotated as the pressing roller rotates and is guided by the metal heat conductor. The endless belt is wholly warmed up by a heat source via the metal heat conductor. This can reduce a time to first print.

To further save energy and reduce the first print time, Japanese Patent Application Publication No. 2007-233011 (JP-2007-233011-A) proposes a fixing device that directly heats an endless belt not via the metal heat conductor.

As shown in FIG. 14, such a fixing device omits the above-described pipe-shaped metal heat conductor from inside the endless belt 100, and is provided with a plate-state nip formation unit 500 facing the pressing roller 400 instead. Consequently, since the endless belt 100 is directly heated by the heat source 300 at a position other than the nip formation unit 500, heat transfer efficiency is significantly improved saving power. Because of this, the first print time is further decreased while saving the cost due to exclusion of the metal heat conductor.

However, based on recent environmental requirements, further energy saving is expected of the fixing device. For example, in a conventional image forming apparatus, when a print job does not exist, i.e., during a standby state, to instantly start printing upon receiving a print job, an fixing roller (or a fixing belt) and a pressing roller in a fixing device is controlled to maintain a prescribed temperature by repeatedly turning on/off a heater located in the fixing device e, which is not an energy-efficient operation.

Conventional attempts to reduce power consumption can be roughly classified into two types: one that improves the above-described heating system as disclosed in JP-2007-334205-A and JP-2007-233011-A, and another that improves controlling an internal heater as disclosed, for example, in Japanese Patent No. 4423070 (JP-4423070-B). However, there is a limit to how much power can be saved with these approaches.

Further, a fixing device capable of saving power by reducing radiation of heat therefrom has been proposed as disclosed in Japanese Patent Application Publication No. 2006-133318 (JP-2006-133318-A). However, a structure of the fixing unit 20 has a complex structure.

SUMMARY OF THE INVENTION

Accordingly, the present invention provides a novel fixing device that includes a rotatable fixing member to heat a side of a recording media bearing an unfixed image, a heat source to heat the rotatable fixing member, a rotatable pressing member to press against the fixing member and form a nip on the fixing member, a housing to accommodate the fixing member and the pressing member, a conveyance path including the nip to convey a recording medium; a shutter disposed on an upstream or downstream side of the nip, and a shutter actuator to move the shutter to open and close the conveyance path. The housing holds the shutter and the shutter actuator.

In another aspect of the present invention, an engagement-disengagement unit is provided to relatively approximate and separate the fixing member to and from the pressing member to form and cancel the nip, wherein the shutter actuator is linked with the engagement-disengagement unit.

In yet another aspect of the present invention, the shutter actuator includes an input side member to receive power from the engagement-disengagement unit, an output side member to drive the shutter, and a transmission mechanism to transmit the power from the input side member to the output side member.

In yet another aspect of the present invention, the output side member employs a cam.

In yet another aspect of the present invention, an operation time of the engagement-disengagement unit is changed in accordance with ambient temperature.

In yet another aspect of the present invention, the shutter is placed downstream of the nip.

In yet another aspect of the present invention, the housing includes a first guide to guide a fixing member side surface of the recording medium passing through the nip, and a separator to separate the recording medium from the fixing member. The shutter is disposed between the first guide and the separator.

In yet another aspect of the present invention, the fixing device further includes an elastically deformable seal attached to the shutter. The housing further includes a second guide to guide a pressing member side surface of the recording medium passing through the nip and is pressed against the second guide via the seal.

In yet another aspect of the present invention, the shutter includes thermal insulation member on its nip side surface.

In yet another aspect of the present invention, the shutter slides in a prescribed direction.

In yet another aspect of the present invention, the housing guides the shutter when it slides.

In yet another aspect of the present invention, low-friction treatment is applied to a contact section of the shutter contacting the recording medium.

In yet another aspect of the present invention, an image forming apparatus having the above-described fixing device

BRIEF DESCRIPTION OF THE SEVERAL VIEWS OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION OF THE INVENTION

Figure 1:
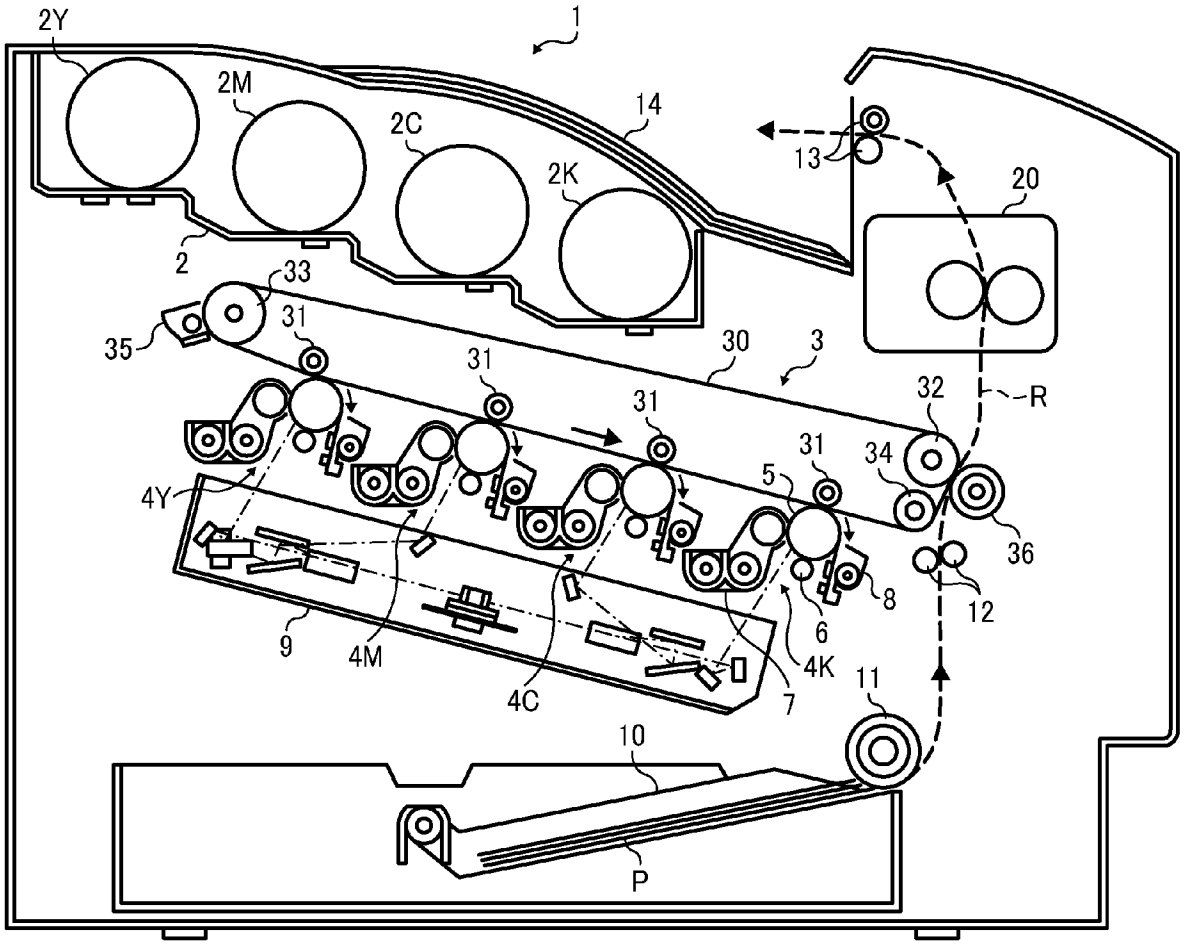
FIG. 1 is a cross-sectional view illustrating a schematic configuration of an image forming apparatus according to one embodiment of the present invention.

Referring now to the drawings, wherein like reference numerals designate identical or corresponding parts throughout the several views thereof and in particular to FIG. 1, an overall configuration and operation of an image forming apparatus according to one embodiment of the present invention is described. The image forming apparatus 1 of FIG. 1 is a color laser printer having four image forming units 4Y, 4M, 4C, and 4K at a center of an apparatus main body. Each of the four image forming units 4Y, 4M, 4C, and 4K accommodates different color developer corresponding to a color component of yellow (Y), magenta (M), cyan (C), and black (K). However, each of the four image forming units 4Y, 4M, 4C, and 4K has a similar configuration.

Specifically, each of the four image forming units 4Y, 4M, 4C, and 4K is provided with a drum shaped photoconductor 5 serving as a latent image-bearing body, a charger 6 to charge a surface of the photoconductor 5, a developing device 7 to supply toner to the photoconductor 5, and a cleaner 8 to clean the surface of the photoconductor 5. As shown in FIG. 1, the black photoconductor 5, the charger 6, the developing device 7, and the cleaner 8 each provided in the image forming unit 4K only have affixed signs, respectively, and the other image forming units 4Y, 4M, and 4C omit the affixed signs, respectively.

Below the image formation units 4Y, 4M, 4C, and 4K, an exposure unit 5 is disposed to expose the surface of the photoconductive member 5. The exposure unit 9 has a polygon mirror, an fθ lens, a reflector mirror, and a light source or the like and irradiates laser light onto each surface of the photoconductive member 5 based on image data.

Above the image formation units 4Y, 4M, 4C, and 4K, a transfer unit 3 is disposed. The transfer unit 3 includes an intermediate transfer belt 30 as a transfer member, four primary transfer rollers 31 as a primary transfer device, a secondary transfer roller 36 as a secondary transfer device, a secondary transfer backup roller 32, a cleaning backup roller 33, a tension roller 34, and a belt cleaner 35.

The intermediate transfer belt 30 is an endless-belt and is stretched around the secondary transfer backup roller 32, the cleaning backup roller 33, and the tension roller 34. The intermediate transfer belt 30 circulates in a direction as indicated by arrow in the drawing as the secondary transfer backup roller 32 rotates.

The four primary transfer rollers 31 respectively form primary transfer nips holding the intermediate transfer belt 30 with each photoconductor 5 therebetween. A power supply, not illustrated, is connected to each of the primary transfer rollers 31, and a given direct current voltage (DC) and/or an alternating current voltage (AC) is applied to the each of the primary transfer rollers 31 therefrom.

The secondary transfer roller 36 holds the intermediate transfer belt 30 together with the secondary transfer backup roller 32 forming a secondary transfer nip thereon. Further, similar to the primary transfer roller 31, a power supply, not shown, is connected to the secondary transfer roller 36, and a given direct current voltage (DC) and/or an alternating current voltage (AC) is applied to the secondary transfer roller 36 therefrom.

The belt cleaning unit 35 includes a cleaning blade and a cleaning brush each contacting the intermediate transfer belt 30. A waste toner transfer hose, not shown, extending from the belt cleaner 35 is connected to an entrance of a waste toner accommodating instrument, not shown.

A bottle container 2 is provided at an upper section in a printer body. To the bottle container 2, four toner bottles 2Y, 2M, 2C, and 2K each storing toner to be replenished are detachably attached. Multiple supply paths, not shown, are provided between the developing device 7 and the toner bottles 2Y, 2M, 2C, and 2K, respectively, so that toner is supplied to each developing device 7 from each of the toner bottles 2Y, 2M, 2C, and 2K via the supply path.

At a bottom of the printer body, a sheet feeding tray 10 accommodating sheets P as a recording medium and a sheet feeding roller 11 to feed the sheet P from the sheet feeding tray 10 are provided. The recording medium includes a cardboard, a postcard, an envelope, a thin sheet, a coated sheet (e.g., a coated sheet, an art sheet, etc.), a tracing paper sheet, and an OHP (Over Head Projector) sheet or the like beside a plain paper sheet. Although, it is not shown, a manual sheet feeding mechanism may be provided.

A conveying path R is disposed to convey the sheet P from the sheet feeding tray 10 to an outside of the printer body through the secondary transfer nip. On the conveying path R, a pair of registration rollers 12 is disposed upstream of the secondary transfer roller 36 in a sheet conveying direction as a transportation device to convey the sheet P to the secondary transfer nip.

Further, a fixing unit 20 is disposed on the downstream side of the secondary transfer roller 36 in the sheet conveying direction to fix an unfixed image transferred onto the sheet P. A pair of sheet ejection rollers 13 is provided downstream of the fixing unit 20 in the sheet conveying direction on the conveyance path R to eject the sheet outside the apparatus. On the top of the printer body, a sheet ejection tray 14 is provided to stock sheets P ejected outside the apparatus.

Now, a basic operation of the printer according to one embodiment of the present is described with reference to FIG. 1. When image forming starts, each photoconductor 5 in each of the image formation units 4Y, 4M, 4C, and 4K is driven and rotated clockwise in the drawing by a driving device, not shown. Then, the surface of each photoconductive member 5 is uniformly charged by the charger 6 to have a given polarity. Subsequently, laser light is irradiated from an exposure 9 onto a surface of the each of the uniformly charged photoconductors 5, and an electrostatic latent image is formed thereon. Here, each photoconductive member 5 is exposed to light having monochromatic image information of yellow, magenta, cyan, and black generated by resolving a prescribed full-color image. Accordingly, when toner is supplied to the electrostatic latent image formed on each photoconductor 5 by each developing device 7 in this way, the electrostatic latent image is rendered to be a sensible image as a toner image (i.e., image visualization).

Further, when image formation starts, the secondary transfer backup roller 32 rotates and operates counterclockwise in the drawing and circulates the intermediate transfer belt 30 as shown by arrow therein. To each primary transfer roller 31, a voltage subjected to either a constant current or constant voltage control having an opposite polarity to a charge polarity of toner is applied. Hence, a transfer electric field is formed between each photoconductor 5 and each primary transfer roller 31 at the primary transfer nip.

When a toner image of each color borne on the photoconductor 5 reaches the primary transfer nip as each photoconductor rotates, the toner image on each photoconductor 5 is transferred and superimposed on the intermediate transfer belt 30 one by one at the above primary transfer nip in the transfer field. Thus, a full-color toner image is borne on the surface of the intermediate transfer belt 30. Further, toner not transferred from each photoconductor 5 to the intermediate transfer belt 30 is removed therefrom by a cleaner 8. After that, charge on the surface of each photoconductor 5 is eliminated by a charge eliminator, not shown, so that a surface potential thereof is initialized.

At the bottom of the image forming apparatus 1, the sheet feed roller 11 starts rotation driving so that a sheet P is sent from the sheet feeding tray 10 to the conveyance path R. The sheet P sent to the conveyance path R is transported by the pair of registration rollers 12 to the secondary transfer nip formed between the secondary transfer roller 36 and the secondary transfer backup roller 32 at a prescribed time. At this moment, a transfer voltage having a reverse polarity to a charge polarity of a toner image on the intermediate transfer belt 30 is applied to the secondary transfer roller 36. Thus, a transfer field is formed at the secondary transfer nip.

After that, when it reaches the secondary transfer nip as the intermediate transfer belt 30 circulates, the toner image on the intermediate transfer belt 30 is transferred onto the sheet P at once in the transfer field formed at the secondary transfer nip. Residual toner not transferred from the intermediate transfer belt 30 onto the sheet P is removed therefrom by a cleaner 35. The thus removed toner is then transported to a waste toner accommodating instrument, not shown, and thereby collected therein.

After that, the sheet P is transported to the fixing unit 20 and the toner image is fused thereon by the fixing unit 20. Subsequently, the sheet P is discharged by the sheet ejection roller 13 to an outside of the apparatus and is stocked on the sheet ejection tray 14.

Although the above-described embodiment relates to full-color image formation on a sheet, a monochromatic image can be formed using four image formation units 4Y, 4M, 4C, and 4K. Twin or trivalent color images can also be formed using two or three image formation units.

Figure 2:
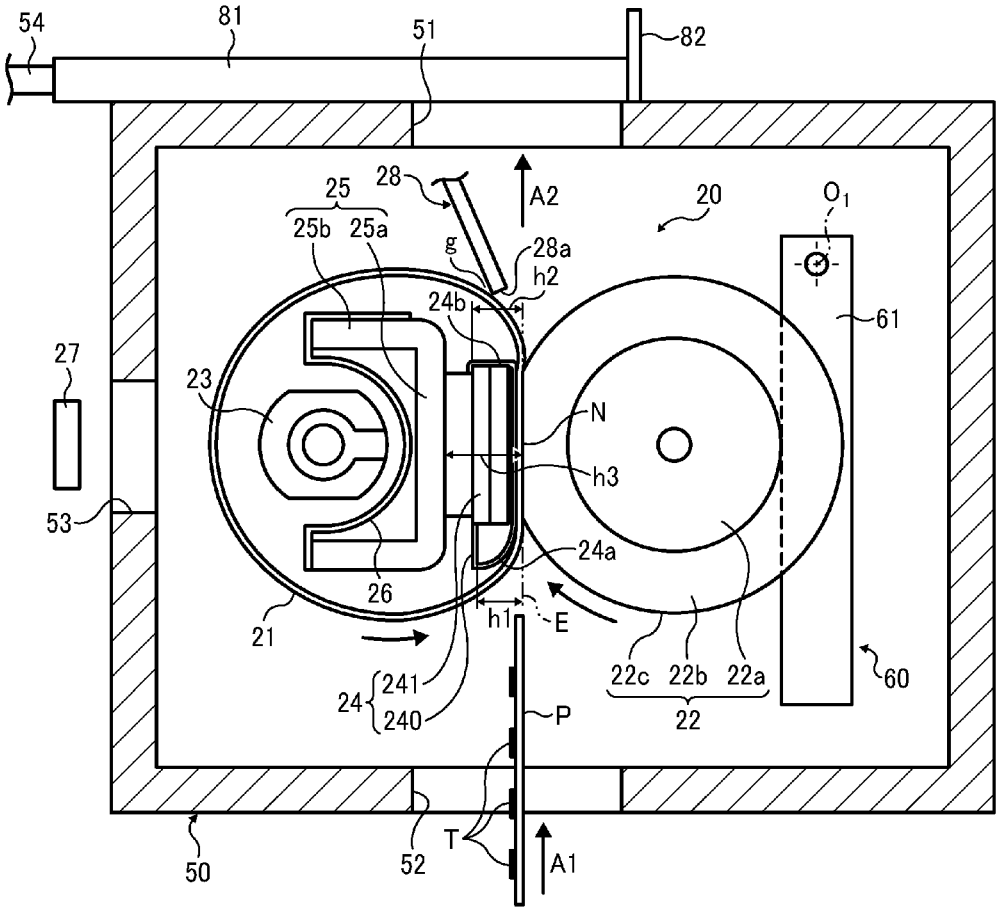
FIG. 2 is a cross-sectional view illustrating a schematic configuration of a fixing device installed in the image forming apparatus.

Now, a configuration of the fixing unit 20 is described more in detail with reference to FIG. 2. As shown there, the fixing unit 20 includes a fixing belt 21 as a rotatable fixing member, a pressing roller 22 located opposite the fixing belt 21 as a rotatable pressing member, and a halogen heater 23 to a heat the fixing belt 21 as a heat source. The fixing unit 20 further includes a nip formation unit 24 disposed inside the fixing belt 21, a stay 25 as a supporter to support the nip formation unit 24, and a reflector 26 to reflect light emitted from the halogen heater 23. The fixing unit 20 further includes a separator 28 to separate a sheet from the fixing belt 21 and a pressing device, not shown, to press the pressing roller 22 against the belt fixing 21 or the like.

The above-described fixing belt 21 is composed of a thin-walled flexible endless belt (including a film) to heat a side of a sheet P bearing an unfixed image. Specifically, an inner circumferential substrate of the fixing belt 21 is made of metal, such as nickel, SUS, etc., or plastic, such as polyimide (PI), etc. An outer circumferential release layer is made of tetrafluoroethylene-perfluoroalkyl vinyl ether copolymer (PFA), and polytetrafluoroethylene (PTFE) or the like. Further, it is possible to insert an elastic layer made of rubber, such as silicone rubber, foamed silicone rubber, fluoro rubber, etc., between the substrate and the release layer.

The above-described pressing roller 22 includes a metal core 22*a*, an elastic layer 22*b* made of a foam silicone rubber, silicone rubber, or fluorine rubber, etc., disposed overlying the metal core 22*a*, and a release layer 22*c* consisting of PTFE and PFA or the like disposed overlying the surface of the elastic layer. The pressing roller 22 is pressed against the fixing belt 21 by a pressing device, not shown, and contacts the nip formation unit 24 via the fixing belt 21. In a contacting region in which the pressing roller 22 and the fixing belt 21 contact in pressure with each other, the elastic layer 22*b* of the pressing roller 22 is crushed and a nip N is formed with a given width. The pressure roller 22 is configured to rotate when driven by a rotation driving source M1, such as a motor, etc. When the pressure roller 22 is driven and rotated, a driving force thereof is transmitted to the fixing belt 21 through the nip N, and the fixing belt 21 is thereby driven and rotated.

In this embodiment, the pressing roller 22 is a solid state, but can be a hollow roller. In such a situation, a heat source, such as a halogen heater, etc., can be disposed inside the pressing roller 22. Further, in absence of the elastic layer, a heat capacity decreases while improving fixative. However, when an unfixed toner is crushed and fixed, fine convexoconcave on the surface of the belt is transferred onto an image thereby causing shiny irregularity in a solid image. To prevent that, a thick elastic layer having a thickness of more than 100 micrometers is desirably provided. That is, since the fine convexoconcave can be absorbed by elastic deformation of the elastic layer having the thickness of more than about 100 micrometer, occurrence of glossy irregularity can be avoided. The elastic layer 22*b* may be made of solid rubber or sponge rubber when a heat source is not installed in the pressing roller 22. The sponge rubber is more desirable, because it increases thermal insulation performance and heat of the fixing belt 21 is more rarely deprived. Further, the fixing belt 21 and the pressing roller 22 are not limited to those contacting each other, but can simply contact each other without pressure.

Each side end of the above-described heater 23 is secured to each side plate (not shown) of the fixing unit 20. The halogen heater 23 is controlled to generate and output heat, so that temperature (i.e., fixing temperature) of the fixing belt 21 can be a desired level by controlling an output of the halogen heater 23. However, as a heat source to heat the fixing belt 21, an IH (Induction Heater), a heat resistance member, and a carbon heater or the like may be used other than the halogen heater.

The above-described nip formation unit 24 has a base pad 241 and a sliding sheet (e.g., a sheet with low-friction) 240 disposed on the surface of the base pad 241. The base pad 241 longitudinally extends along an axis of the fixing belt 21 (or the pressing roller 22) and receives pressure from the pressing roller 22, thereby defining a shape of the nip N. The base pad 241 is fixed and supported by a stay 25. Hence, deflection of the nip formation unit 24 caused by the pressure of the pressing roller 22 is prevented, so that a uniformed nip width can be obtained along the axis of the pressing roller 22. To ensure performance of preventing the deflection of the nip formation unit 24, the stay 25 is preferably made of metal such as iron, stainless steel, etc., having high mechanical strength. In this embodiment, a surface of the base pad 241 opposed to the pressing-roller 22 is formed flat, so that a shape of the nip N is straight. With the straight shape of the nip N, the pressing force of the pressing roller 22 can be reduced.

The base pad 241 is made of hard and heat-resistant material capable of withstanding temperature up to 200° C. or more to ensure prescribed rigidity. Hence, deformation of the nip formation unit 24 due to the heat is prevented stabilizing a condition of the nip N and quality of an output image in a range of toner fixing temperature. As material of the base pad 241, general heat-resistant resin, such as polyethersulphone (PES), polyphenylene sulfide (PPS), liquid crystal polymer (LCP), polyether nitrile (PEN), polyamide imide (PAI), polyetheretherketone (PEEK), etc., metal, and ceramic or the like can be used.

The sliding sheet 240 is preferably disposed at least on a surface of the base pad 241 opposed to the fixing belt 21. Hence, since the fixing belt 21 slides and rotates on the low friction sheet, a drive torque and load on the fixing belt 21 caused by the friction can be decreased. However, the sliding sheet 240 can be omitted.

The above-described reflector 26 is disposed between the stay 25 and the halogen heater 23. The reflector 26 is secured to the stay 25 and is made of stainless steel or aluminum and the like in this embodiment. Since the reflector 26 is disposed in this way, light emitted from the halogen heater 23 toward the stay 25 is reflected to the fixing belt 21. Hence, an intensity of light emitted to the fixing belt 21 can be increased, thereby capable of efficiently heating the fixing belt 21. Further, since radiant heat traveling from the halogen heater 23 to the stay 25 or the like can be suppressed, energy can be saved.

Although it is not shown in the drawing, at both side ends of the fixing belt 21 in its axial direction, a pair of shields blocking heat radiated from the halogen heater 23 is disposed between the fixing belt 21 and the heater 23. With these, overheat in non-sheet passage regions on the fixing belt can be suppressed especially when sheets are continuously fed, so that damage or deterioration of the fixing belt due to the radiated heat can be prevented.

Although it is not shown in the drawing, both side ends of the fixing belt 21 in its axial direction are held by a belt holder inserted into an inner circumference thereof. In this way, by keeping only the both side ends of the fixing belt 21 with the holder 40, the fixing belt 21 can freely deform between the both side ends other than the nip N. Further, since the nip N has the straight shape, prescribed force is always applied to the fixing belt 21 to transform it into an elliptical shape. Thus, the fixing belt 21 almost has a true round cross section in a radius direction during its rotation at each of the side ends, and changes the shape into the elliptical shape having a minor axis in a normal direction of the nip N between the side ends.

Further, various ideas are applied to the fixing unit 20 of this embodiment to further save energy shortening a time to first print as described below.

Specifically, the halogen heater 23 is enabled to directly heat the fixing belt 21 at a section other than the nip N as a direct heating system. Specifically, without providing any devices between the halogen heater 23 and a left side section of the fixing belt 21 in FIG. 2, radiant heat is directly transferred from the halogen heater 23 to the fixing belt 21 there.

Further, to decrease a heat capacity of it, the fixing belt 21 is made thin while decreasing a diameter thereof. Specifically, thicknesses of the substrate, the elastic layer, the release layer collectively constituting the fixing belt 21 are from about 20 μm to about 50 μm, from about 100 μm to about 300 μm, and from about 10 μm to about 50 μm, respectively, so that the whole thickness is less than 1 mm. Further, a diameter of the fixing belt 21 is from about 20 mm to about 40 mm. In order to achieve the low heat capacity, the entire thickness of the fixing belt 21 is desirably less than about 0.2 mm, and is more preferably less than about 0.16 mm. A diameter of the fixing belt 21 is desirably about 30 mm or less.

Further, in this embodiment, a diameter of the pressing roller 22 is from about 20 mm to about 40 mm almost equivalent to that of the fixing belt 21. It is, however, not limited to each of these sizes. For example, the diameter of the fixing belt 21 may be smaller than that of the pressing roller 22. In such a situation, since a curvature of the fixing belt is smaller than that of the pressing roller 22 at the nip N, the sheet P to be ejected from the nip N is readily separated from the fixing belt 21.

Further, as result of decreasing the diameter of the fixing belt 21 as described above, an inner space of the fixing belt 21 accordingly becomes narrower. However, since the stay 25 is bent at its both side ends forming a rectangular shape to accommodate the halogen heaters 23 therein, the stay 25 and the halogen heater 23 can be layout even in a small space.

Further, to make the stay 25 as large as possible and arrange it in the small space, the nip formation unit 24 is made compact to the contrary. Specifically, a width of the base pad 241 is smaller than that of the stay 25 in the sheet conveying direction. Further, as shown in FIG. 2, the base pad 241 is located in a prescribed position as described below. When respective heights from respective upstream and downstream side edges 24*a* and 24*b* of the base pad 241 in the sheet conveying direction to the nip N or its virtual extension line "E" are represented by h1 and h2, and a maximum height from a section other than the upstream and downstream side edges 24*a* and 24*b* to the nip N or its virtual extension line "E" is represented by h3, the following equality is satisfied; $h1 \leq h3$ and $h2 \leq h3$. With such a configuration, both the upstream and downstream side edges 24*a* and 24*b* of the base pad 241 do not intervene between respective bent portions of the stay 25 on both upstream and downstream sides in the sheet conveying direction and the fixing belt 21, each bent portion can be disposed closer to the inner circumferential surface of the fixing belt 21. Hence, the stay 25 can be arranged in a limited space of the fixing belt 21 as wide as possible keeping its strength. As a result, deflection of the nip formation unit 24 caused by the pressing roller 22 can be avoided improving fixing performance.

Further, in this embodiment, to further ensure strength of it, the stay 25 includes a base section 25A extending in the sheet conveying direction (i.e., a vertical direction in FIG. 2) contacting the nip formation unit 24, and a pair of rising portions 25*b* extending from upstream and downstream sides of a base section 25A in the sheet conveying direction departing from the pressing roller 22 (i.e., a left side in FIG. 2). That is, due to the rising portions 25*b*, the stay 25 has a long cross section from side to side extending in a pressing direction of the pressing roller 22, so that its modulus of section and accordingly mechanical strength of the stay 25 can increase.

Further, strength of the stay 25 increases if a length of the rising portion 25*b* is increased in the pressing direction of the pressing roller 22. Therefore, a leading end of the rising portion 25*b* is desirably positioned beside an inner circumferential surface of the fixing belt 21 as closer as possible. However, since it somewhat vibrates (i.e., disorder movement) during its rotation, the fixing belt 21 likely contacts the leading end of the rising portion 25*b* if the leading end of the rising portion 25*b* is excessively close to the inner circumferential surface of the fixing belt 21. Especially, when a thin fixing belt 21 is utilized as in this embodiment, since a size of vibration amplitude of the fixing belt 21 is large, the leading end of the rising portion 25*b* needs to be carefully set and positioned.

Specifically, a distance "d" between the leading end of the rising portion 25*b* and the inner circumferential surface of the fixing belt 21 in the pressing direction of the pressing roller 22 is preferably at least 2.0 mm, and is more preferably greater than 3.0 mm in this embodiment. Whereas, when the fixing belt 21 is thick by some extent and rarely vibrates, the above-described distance "d" can be set to 0.2 mm. If the reflector 26 is attached to the leading end of the rising portion 25*b* as in this embodiment, the above-described distance "d" needs to be set to a prescribed level in that the reflector 26 does not contact the fixing belt 21.

Hence, by positioning the leading end of it beside the inner circumferential surface of the fixing belt 21 as closer as possible, the rising portion 25*b* can be elongated in the pressing direction of the pressing roller 22. With this, even when the fixing belt 21 with a small-diameter is used, the mechanical strength of the stay 25 can be increased.

Now, a basic operation of a fixing device according to this embodiment is described with reference to FIG. 2. When a power switch of a printer body is turned on, power is supplied to the halogen heater 23. The pressing roller 22 then starts driving clockwise in FIG. 2. Accordingly, the fixing belt 21 is driven and rotated counterclockwise by friction caused by the pressing roller 22 as shown there.

Subsequently, a sheet P bearing an unfixed toner image formed in the above-described image formation process is conveyed in a direction shown by arrow A1 of FIG. 2 while being guided by a guide plate, not shown, to a nip N formed between the pressing roller 22 and the fixing belt 21 under the pressure. Further, the toner image T is fused by heat of the fixing belt 21 and pressure between the fixing belt 21 and the pressing roller 22 onto the surface of the sheet P.

The sheet P with the fixed toner image T thereon is carried out in a direction as shown by arrow A2 from the nip N as shown in FIG. 2. A leading end 28*a* of an separator 28 located near an exit of the nip N is distanced from a surface of the fixing belt 21 forming an separating gap "g" therebetween. The sheet P conveyed from the nip N separates from the fixing belt 21 when contacting the leading end 28*a* of the separator 28 with its leading end. Subsequently, the separated sheet P is exhausted outside the apparatus by a sheet ejection roller and is stocked on an output tray as described above.

Now, a feature of one embodiment of the present invention is described with reference to FIG. 2 and applicable drawings. As shown in FIG. 2, in the fixing unit 20, the fixing belt 21, the pressing roller 22, and the separator 28 are housed in an housing 50 prepared by plastic injection molding or the like. The housing 50 also includes an exit side opening 51 facing an exit side of the nip N, an entrance side opening 52 facing an entrance of the nip N, and a sensor opening 53 facing an outer circumferential surface of the fixing belt 21. A space surrounding the fixing belt 21 and the pressing roller 22 is sealed up by the housing 50 except for these openings 51, 52, and 53.

A temperature sensor 27 is placed outside the sensor opening 53 to detect surface temperature of the fixing belt 21 therethrough. Although it is deployed outside the housing 50 in this embodiment, the temperature sensor 27 can be disposed inside the housing 50. In such a situation, the sensor opening 53 is not required on the housing 50.

The fixing belt 21 and the pressing roller 22 are relatively approximated or engaged and disengaged each other by an engagement-disengagement mechanism 60. Specifically, the nip N is formed at a pressing section therebetween when the fixing belt 21 and the pressing roller 22 are engaged each other by the engagement-disengagement mechanism 60, and is cancelled when these are disengaged each other. Herein below, it is supposed that the pressing roller 22 is movable to approach and separate from the stationary fixing belt 21 as one example.

At an outside of the exit side opening 51 of the housing 50, a plate-like slidable shutter 81 is disposed. The shutter 81 is made of thermal insulation material, such as PET containing for example fiberglass, etc. Further, a slider 82 is attached to a leading end of the shutter 81. The slider 83 is produced by applying low-friction treatment, such as coating of PTFE, etc., to a surface of a metal base. Hence, with the slider 83 disposed on the leading end of the shutter 81, a sheet P can reduce damage when it is fed and contacting the leading end of the shutter 81. The shutter 81 is always biased by an elastic member, not shown, in a direction (e.g. to the left in the drawing) to open the exit side opening 51, and opens and closes the exit side opening 51 by mechanically liking with the engagement-disengagement mechanism 60.

The shutter 81 slides and moves being guided by a guide rail 54 located in the housing 50. As the housing 50 guides the shutter 81 in this way, airtightness of the exit side opening 51 closed by the shutter 81 is improved, and accordingly temperature loss can be effectively prevented in the fixing unit 20. If it does not raise a problem, the above-described guide rail 54 can be disposed in an apparatus body (e.g. a frame) to guide the shutter 81 therein.

Figure 3:
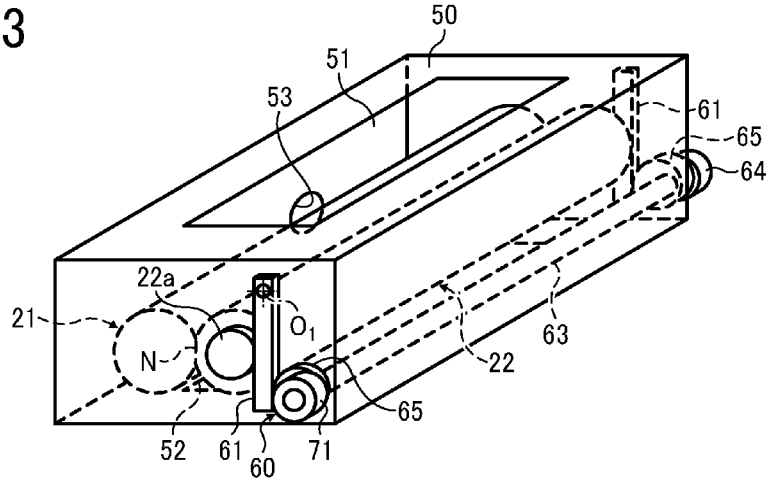
FIG. 3 is a perspective view of the fixing device.
Figure 4:
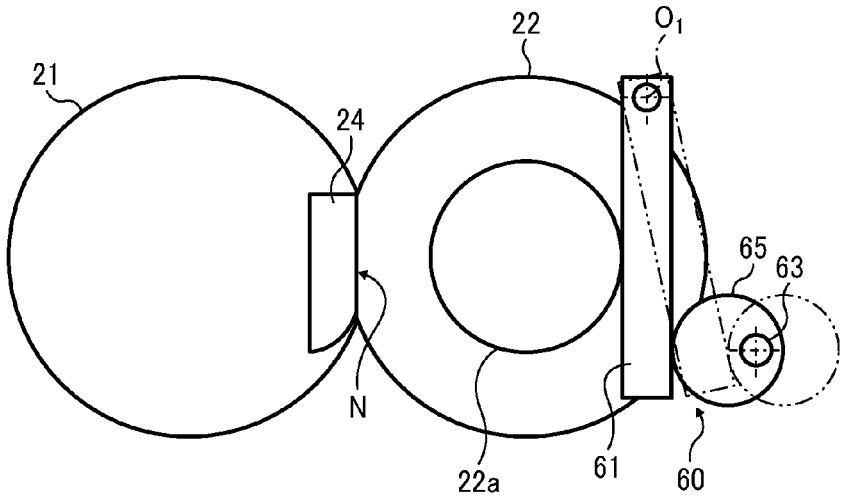
FIG. 4 is a side view illustrating the fixing device and an engagement-disengagement unit.

Further, as shown in FIGS. 3 and 4, a pair of pressing arms 61 constituting the engagement-disengagement mechanism 60 is placed at both sides of the housing 50 in an axial direction of the pressing roller, respectively. Each of the pressing arms 61 is swingably attached to the housing 50 though its one end around an axis $O_1$. The engagement-disengagement mechanism 60 of this embodiment has a drive shaft 63 penetrating the housing 50 in the axial direction, a first drive gear 64 attached to one end of the drive shaft 63, a pair of driving side eccentric disc cams 65 attached to both ends of the drive shaft 63, respectively, and an elastic member, not shown, always pressing the pressing roller 22 in a prescribed direction (i.e., to the right in FIG. 4) to separate the pressing roller 22 from the fixing belt 21 in addition to the pressing arms 61.

A pair of metal cores 22*a* protrudes from the housing 50 at its both sides as a bearing axis of the pressing roller 22 in the axial direction, respectively. To allow this metal core 22*a* to move both in approaching and separating directions to and from the fixing belt 21, the housing 50 has a pair of oval holes at penetration sections from which the metal cores 22*a* penetrate. Each of the pressing arms 61 is placed in between the driving side cam 65 and the metal core 22*a* protruding from the housing 50. Specifically, the rotating metal core 22*a* and the driving side cam 65 are located on a track of the pressing arm 61.

Further, in the above-described configuration, when the first drive gear 64 and the drive shaft 63 are integrally rotated by a rotary driving source provided in the engagement-disengagement mechanism 60, which mainly consists of a stepper motor or the like, not shown, the driving side eccentric cam 65 eccentric about the driving shaft 63 accordingly rotates. When the driving side cam 65 rotates, the pressing arm 61 pressed by the driving side cam 65 swings counterclockwise around the axis $O_1$, as a swinging center and presses the metal core 22*a* of the pressing roller 22 against the fixing belt 21 as indicated by a solid line in the drawing against elastic force always applied to the pressing roller 22 as shown in FIG. 4. Thus, the pressing roller 22 moves as a whole closer to the fixing belt 21 and forms a nip N in a pressure contact section in which the pressing roller 22 and the fixing belt 21 contact each other. When the driving side cam 5 is rotated by the angle of 180° in the direction or reversely rotated by the angle of 180 degrees (as shown by dashed line in FIG. 2), pressure given to the metal core 22*a* by the driving side cam 65 through the pressing arm 61 disappears. Consequently, the pressing roller 22 moves in a direction apart from the fixing belt 21 due to elastic force of the elastic member, so that the nip N disappears. The engagement-disengagement mechanism 60 only forms the nip N during a printing mode, and otherwise does not, such as a waiting mode, etc. That is, the nip N disappears in the waiting mode.

Figure 5:
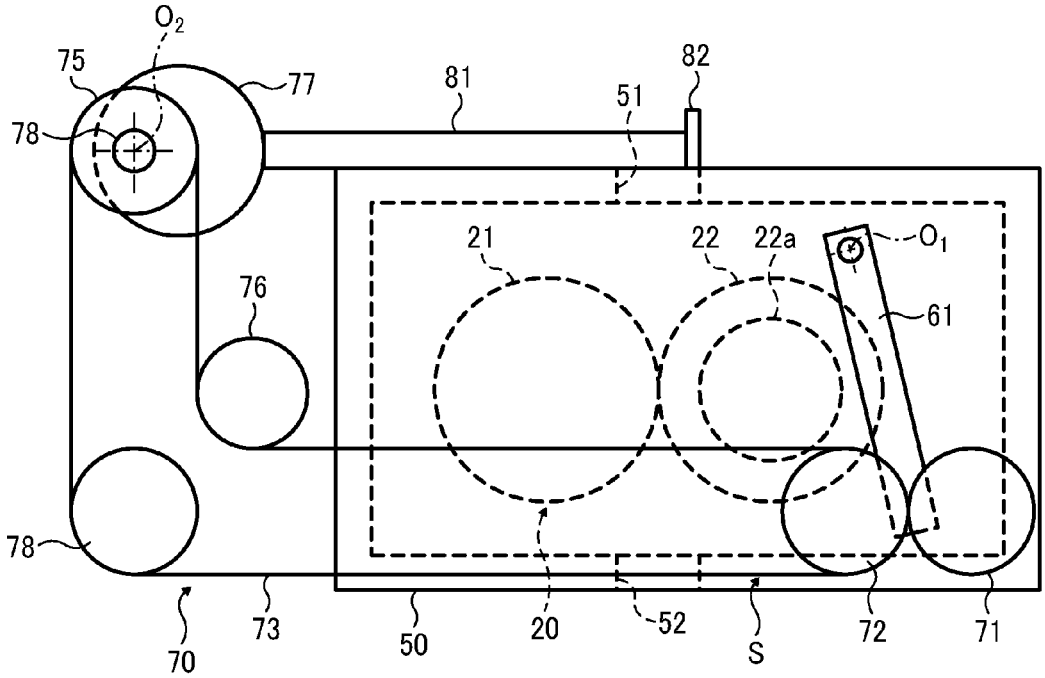
FIG. 5 is a side view illustrating the fixing device and a transmission mechanism when a shutter is closed.
Figure 7:
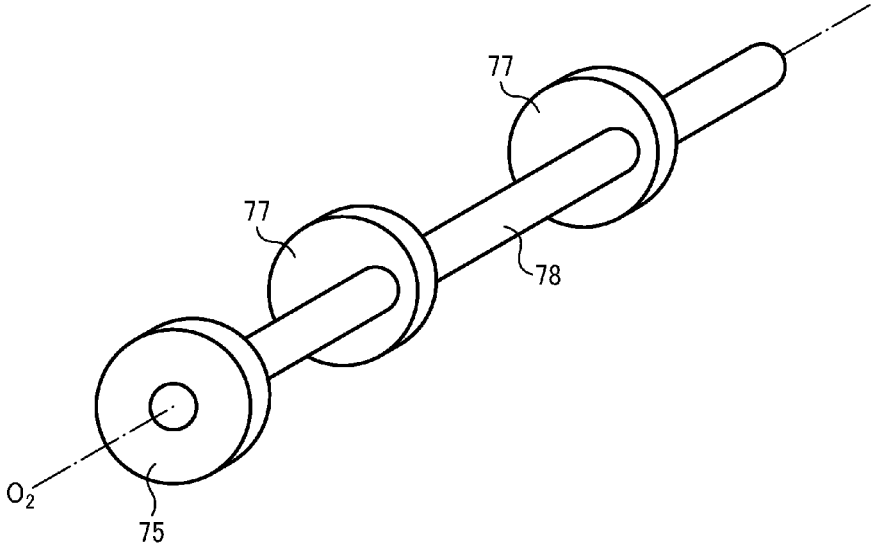
FIG. 7 is a perspective view illustrating an assembly having a driven pulley and a driven side cam.

Such movement of the engagement-disengagement mechanism 60 is transmitted to the shutter 8 through an appropriate transmission mechanism 70 as shown in FIG. 5. Specifically, the transmission mechanism 70 has a second drive gear 71 (see FIG. 3) attached to the other end of the driving shaft 63, a driving pulley 72 with a gear section engaging with the second driving gear 71, and an idler pulley 74. The transmission mechanism 70 also includes a driven pulley 75, a tensioner pulley 76, and a belt 73 stretched by these pulleys 72, 74, 75, and 76. The transmission mechanism 70 again includes a driven side disc cam 77 and a driven shaft 78 supporting the driven pulley 75. As shown in FIG. 7, a pair of driven side cams 77 is attached to the driven shaft 78 with a deviation. The driven pulley 75 is also attached to one end of the driven shaft 78.

With the above-described configuration, when the rotation driving source starts driving and rotates the drive shaft 63 (see FIG. 3), torque thus generated is transmitted to the driven side cam 77 through the second driving gear 71, the driving pulley 72, the belt 73, the driven pulley 75, and the driven shaft 78 as shown in FIG. 5. Specifically, the driven side cam 77 rotates around a central axis $O_2$ of the driven shaft 78. A base end of the shutter 81 is always elastically pressed in an opening direction (to the left in FIG. 5) of the exit side opening 51 and engages the driven side cam 77. Accordingly, as the driven side cam 77 rotates and presses against the base end of the shutter 81, the shutter 81 slides and moves against the elastic force and closes the exit side opening 51 of the housing 50 (see FIG. 5).

Figure 6:
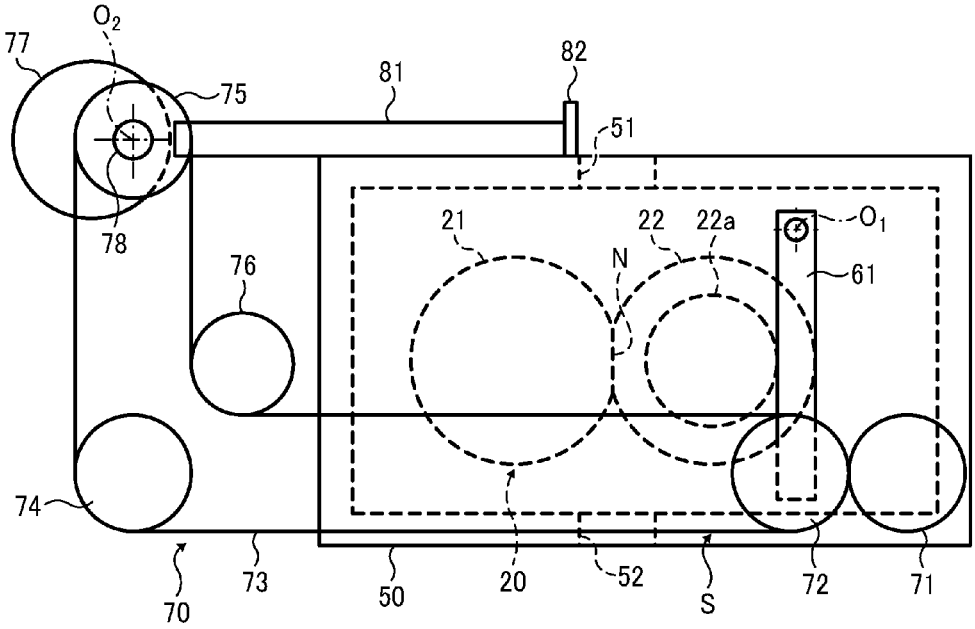
FIG. 6 is a side view illustrating the fixing device and the transmission mechanism when the shutter is open.

With the above-described configuration, by sliding and moving the shutter 81 in conjunction with cancellation and formation of the nip N by the engagement-disengagement mechanism 60, the exit side opening 51 can be open and closed. In other words, when the nip N formation is cancelled as shown in FIG. 5, the exit side opening 51 is closed by the shutter 81. Since a sheet P is not fed to the fixing unit 20 when the nip N formation is cancelled, a problem, such as sheet jam, etc., does not occur even if the exit side opening 51 is closed. On the other hand, when the nip N is formed as shown in FIG. 6, the exit side opening 51 is open to allow the sheet P to pass through and exit the nip N. To synchronize such closing and opening of the exit side opening 51 with the formation and cancellation of the nip N in this way, a velocity ratio of the transmission mechanism 70 (i.e., a gear ratio between the driving shafts 63 and 78) is set to one.

Thus, in one embodiment of the present invention, since the fixing belt 21 and the pressing roller 22 are installed in the housing 50 and the opening 51 of the housing 50 is opened and closed by the shutter 81, the shutter 81 and the opening 51 are open to allow sheet passage during fixation and otherwise (i.e., not during fixation) closed, heat radiation from the fixing unit 20 can be suppressed upgrading heat insulation. As a result, temperature decrease, especially that of the fixing belt 21, during a waiting mode in the fixing unit 20 can be prevented, so that power to be consumed in heating up the fixing belt 21 again can be reduced when a print job is given even with a simple configuration.

Since opening and closing of the opening 51 by the shutter 81 is synchronized with formation and cancellation of the nip N, and accordingly the opening 51 is open for the minimum time period for sheet passage, useless opening thereof can be prevented and the heating efficiency is further improved. Further, at this moment, since the shutter 81 causes its sliding movement mechanically linking with the engagement-disengagement mechanism 60 that causes formation and cancellation of the nip N through the transmission mechanism 70, a private use driving source for opening and closing the shutter 81 is not needed decreasing a cost and simplifying a layout.

Further, since power consumption in a standby mode is reduced in this fixing unit 20, various conventional heater control systems can be employed as are. Accordingly, in conjunction with these heater control systems, energy can be further saved.

Further, since the slider 82 is disposed on the leading end of the shutter 81, specifically low-friction processing is applied to a contact area contacted by a sheet P, the sheet P passing through the nip N can decrease damage due to contacting the leading end of the opening shutter 81.

Further, when fixing operation is executed in low temperature environment, such as in winter, etc., condensation sometimes occurs inside the fixing unit 20 due to moisture contained in a sheet P. This is especially true in the above-described various embodiments of the present invention, because leakage of air from inside the fixing unit 20 to outside thereof is prohibited by the shutter 81, and occurrence of the condensation is increasingly promoted. Then, to prevent this problem, ambient temperature is detected and operation timing of the engagement-disengagement mechanism 60 is desirably changed in accordance with the ambient temperature. Specifically, when it is determined that current environment likely generates the condensation (for example, ambient temperature is less than 15° C., etc.), the engagement-disengagement mechanism 60 starts operation and forms the nip N while opening the shutter 81 to release the inner air from the fixing unit 20 immediately after a printing job is received (i.e., before consolidation).

Although the above-described example employs the belt transmission system as a transmission mechanism 70, any system can be adopted as the transmission mechanism 70 if it can mechanically transmit movement of the engagement-disengagement mechanism 60 to the shutter 81. For instance, a gear train or a linkage can be used as the transmission mechanism 70. Further, an optional configuration is employed in the engagement-disengagement mechanism 60, and various known mechanisms can be adopted. Heretofore, in the above-described embodiments, sliding movement of the shutter 81 and the pressing roller 22 is achieved by the cams 65 and 77 as one example. However, such a moving mechanism can be replaced with the other mechanism, such as a linkage, etc.

The shutter 51 is only disposed at the exit side opening 51 of the housing 50, and accordingly a problem of heat radiation from the entrance side opening 52 remains in the embodiment of FIG. 2. However, in a vertical transfer type fixing unit 20 that vertically conveys a sheet P as shown in the drawing, since a main heat radiation section is limited to the exit side opening 51, a substantial problem does not occur if the shutter is omitted from the entrance side opening 52. Of course, if heat radiation from the entrance side opening 51 raises a problem as in the horizontal transfer type or the like, a shutter like the shutter 81 interacting with the engagement-disengagement mechanism 60 through the transmission mechanism can be placed only at the entrance side opening 52 or both at the entrance side opening 52 and the exit side opening 51. Further, since the sensor use opening 53 usually has relatively a small diameter, heat radiation therethrough does not raise a serious problem. However, a shutter with a similar configuration to the shutter 81 can be placed at the sensor opening 53 to open and close the sensor opening 53.

Figure 8:
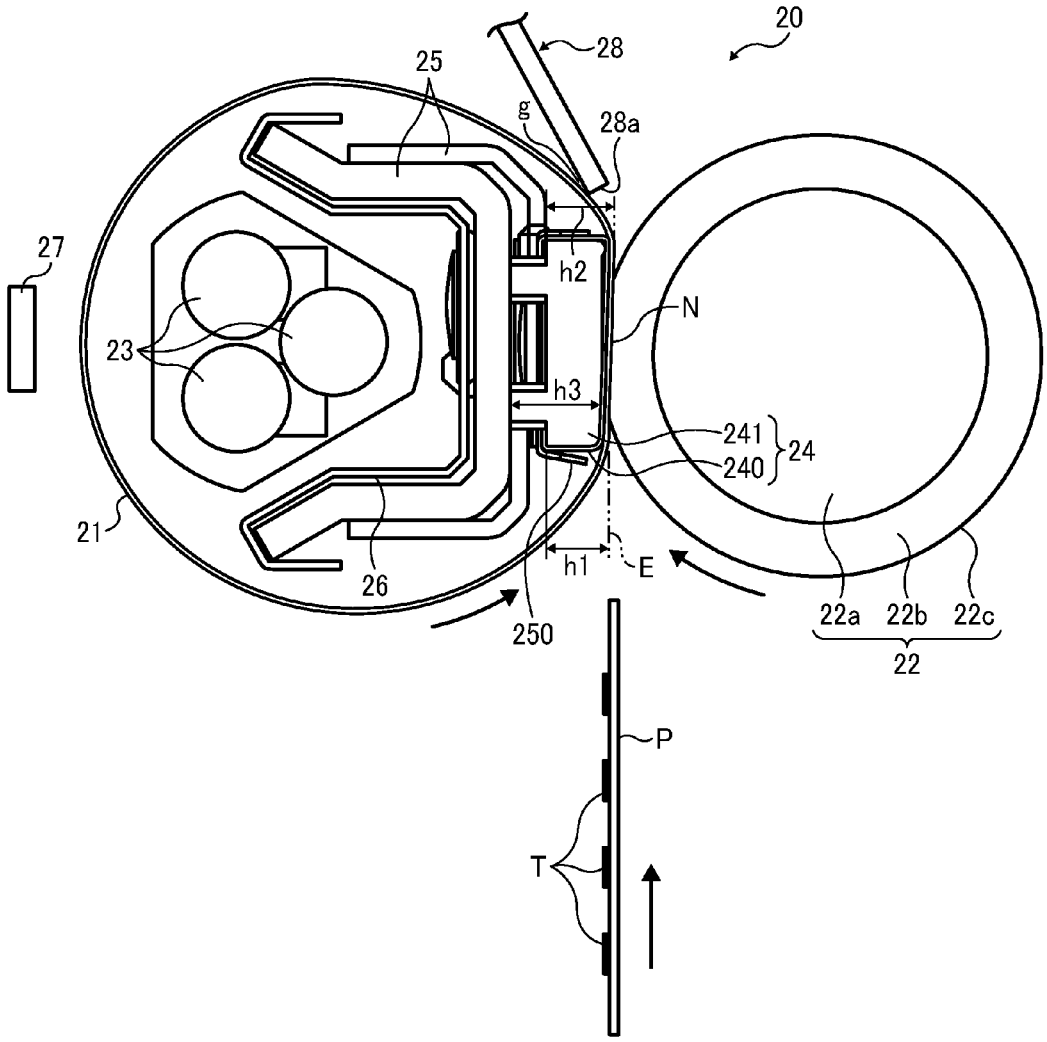
FIG. 8 is a cross-sectional view illustrating another embodiment of the fixing device.

Now, a fixing unit 20 according to another embodiment of the present invention is described with reference to FIG. 8. The fixing unit 20 of this embodiment has three halogen heaters 23 as a heat source differentiating a heat generation range per halogen heater 23 to heat a range of the fixing belt 21 corresponding to various widths of a sheet. Further, a metal plate 250 is disposed almost surrounding the nip formation unit 24, so that the nip formation unit 24 can be supported by the stay 25 through the metal plate 250. The other configuration of the fixing unit 20 is basically the same to that of the embodiment as shown in FIG. 2.

Also in this embodiment, the fixing belt 21, the pressing roller 22, and the separator 28 are similarly housed in the housing 50 as in the embodiment of FIG. 2. Accordingly, similar effect can be again obtained by placing the shutter 81 at the opening as obtained in the embodiment of FIG. 2.

A fixing device of yet another embodiment is now described with reference to FIG. 9. The fixing system 20 of this embodiment employs an IH (i.e., an induction heater) as a heat source heating a fixing member 21 as described below in detail.

Figure 9:
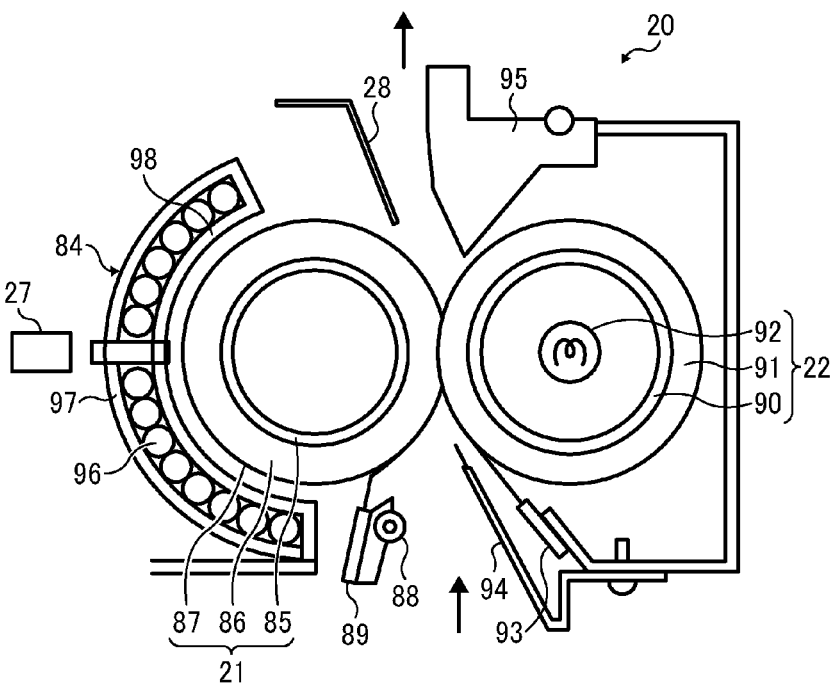
FIG. 9 is a cross-sectional view illustrating yet another embodiment of the fixing device.

As shown in FIG. 9, the fixing unit 20 includes an induction heating unit 84 (e.g., a magnetic flux generator), an fixing roller 21 as an fixing member opposed to the induction heater 25, a pressing roller 22 as a pressing device pressing against the fixing roller 21, an entrance guide plate 94, a spur guide plate 88, an separator 28, an exit guide plate 95, and thermistors 89 and 93 or the like.

The fixing roller 21 is a laminate having a diameter of about 40 mm constituted by sequential stacking a metal core 85 made of iron or stainless steel and the like, a heat insulation elastic layer 86 made of foam silicone rubber or the like overlying the metal core 85, and a sleeve layer 87. Thus, a heat generation layer in the sleeve layer 87 generates electromagnetic induction heat upon receiving the magnetic flux issued from the induction heating unit 84. Further, either the thermistor 89 or the temperature sensor 27 detects temperature (i.e., fixing temperature) of the fixing roller 21, and an amount of calorie of the induction heating unit 84 is adjusted based on detection result of those thermistor and sensor.

In this embodiment, a heater, such as a halogen heater etc., is installed in the pressing roller 22 to increase heating efficiency of the fixing roller 21. Thus, the pressing roller 22 is heated by radiant heat of the heater 92 when the heater 92 is supplied with power, and accordingly a surface of the fixing roller 21 is heated through the pressing roller 22. Further, the thermistor 93 detects temperature of the pressing roller 22, and calorie of the heater 92 is adjusted based on the detection result.

The induction heating unit 84 mainly consists of a coil unit 96 (e.g., an exciting coil), a core unit 97 (e.g., an excitation coil core), and a coil guide 98 or the like. The coil unit 96 is formed by winding a Litz wire composed of a bundle of slender wires around the coil guide 98 disposed almost covering an outer circumferential surface of the fixing roller 20. The coil guide 98 faces the outer circumferential surface of the fixing roller while holding the coil unit 96. The core unit 97 is enabled to generate a magnetic flux efficiently issued to the heat generation layer of the fixing roller 21, and is composed of ferromagnetic member with relative permeability of approx. 2500, such as ferrite, etc.

Again in this embodiment of FIG. 9, the fixing belt 21, the pressing roller 22, the separator 28, each of guide plates 88, 94, and 95, and thermistors 89, and 93 are similarly housed in the housing 50 as in the embodiment of FIG. 2. Thus, similar effect can be again obtained as in the embodiment of FIG. 2 by placing the shutter 81 at the opening.

However, the housing 50 is expected only to accommodate at least the fixing member 21 and the pressing member 22. That is, the other members constituting the fixing unit 20, such as the separator 28, the temperature sensor 27, various types of the guide plates, etc., can be disposed outside the housing 50.

Now, an exemplary configuration of the fixing unit 20 described heretofore is more specifically described with reference to FIG. 10. The fixing unit 20 employs a fixing belt 21 as a fixing member having similar configuration to that of FIG. 2. A separator 28, the shutter 81, and a pair of guiders 41 and 42 are located downstream of the nip N. The pair of guiders 41 and 42 is opposed to each other and guides both sides of a sheet facing the fixing belt 21 and the pressing roller 22, respectively, when it passes through the nip N. The pair of guiders 41 and 42 is secured to the housing, not shown, sandwiching the transport channel R. Among the pair of guides 41 and 42, a first guider 41 disposed on a side of the fixing belt 21 right above the separator 28, while a leading end of a second guider 42 extends on a side of the pressing roller 22 up to near the outer circumferential surface of the pressure roller 22.

Figure 10:
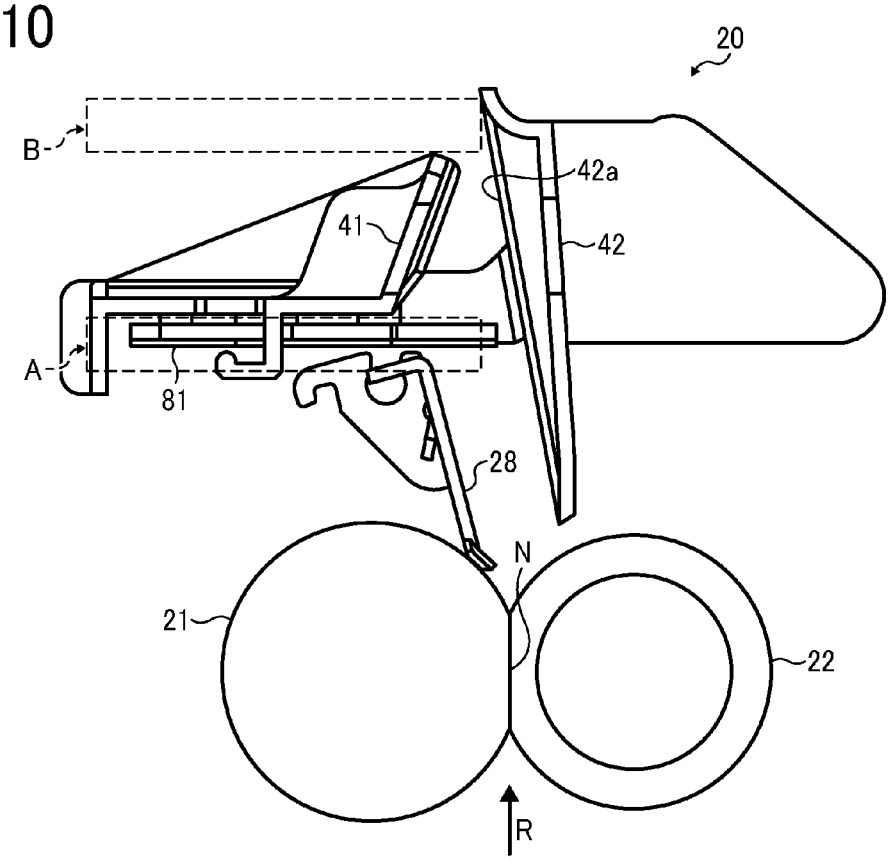
FIG. 10 is a cross-sectional view illustrating yet another embodiment of the fixing device.

In the embodiment of FIG. 10, the shutter 81 is located in a region A between the first guider 41 and the separator 28. The shutter 81 can also be located in a region B downstream of the first guider 41 in the transport direction. However, in such a configuration, since a distance from the nip N increases, and consequently effect of thermal storage deteriorates when the opening is closed. Accordingly, the shutter 81 is preferably placed between the first guider 41 and the separators 28 (i.e., a region A).

Figure 11:
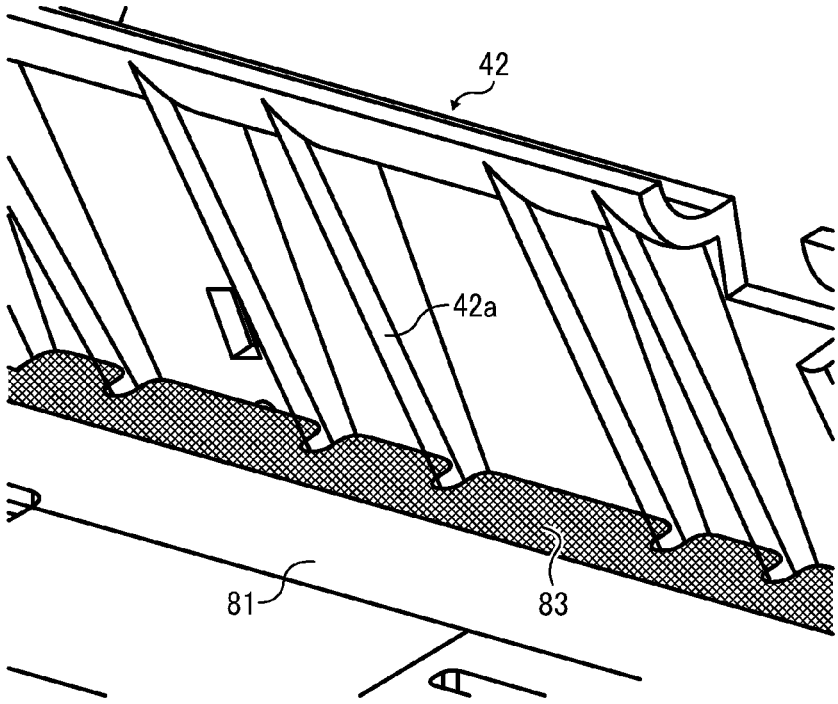
FIG. 11 is a perspective view illustrating an outlet side of a nip when the shutter is closed.

Further, multiple ribs are usually provided on guiding surfaces of the guiders 41 and 42 and extends along the sheet transport direction to prevent the sheet from absorbing water droplets caused by condensation. For example, a rib 42 is formed on a guide surface on a second guider 42 as shown in FIG. 11. Since ruggedness is accordingly formed by the ribs 42*a* on the guide surface, a gap is created between the leading end of the shutter 81 and the second guider 42 when the shutter 81 is closed. As a result, heat shielding effect caused by the shutter 81 deteriorates. To prevent creation of such a gap, a seal 83 made of elastic material, such as rubber, sponge, etc., is desirably attached to the leading end of the shutter 81 as shown in the drawing, so that the seal 83 is elastically deformed to tightly contact the roughness of the guide surface of the second guider 42 when the shutter is closed and the shutter 81 is pressed against the second guider 42. By contrast, since the seal 83 is necessarily disposed at least between the second guider 42 and the shutter 81, the seal 83 can be attached to a guide surface of the second guider 42.

The above-described shutter actuator 70 can adopt any configuration if it can mechanically convey movement of the engagement-disengagement mechanism 60 to the shutter 81.

Figure 12:
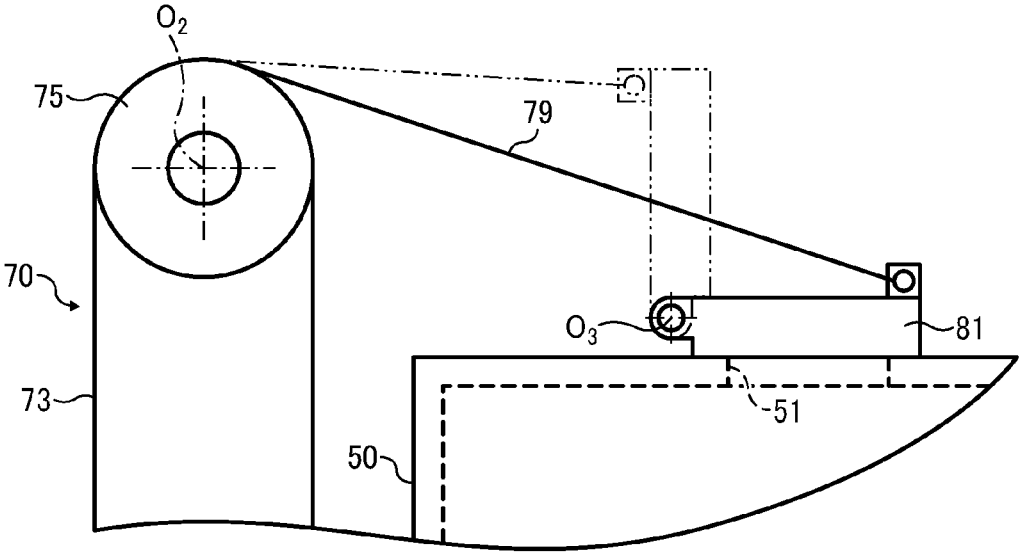
FIG. 12 is a side view illustrating another embodiment of the transmission mechanism and the shutter.

FIG. 12 illustrates a modification of the mechanism moving the shutter 81. In this embodiment, a base end of a shutter 81 is swingably attached to the housing 50 around a rotational axis $O_3$. Specifically, from the transmission mechanism 70 shown in FIGS. 5 and 6, the driven side cam 77 is removed, while a funicular member 79, such as a string, etc., is wound around the driven side pulley 75 and is attached to a leading end of the shutter 81. With such a configuration, by rotating the driven pulley 75 and thereby winding up and unwinding the funicular member 79, the shutter 81 is rotated around the central axis $O_3$ and the exit side opening 51 is open and closed. This embodiment is effective to a system in which sliding movement of the shutter 81 cannot be adopted due a limited space.

Since each of the elements (i.e., the second driven gear 71, the transmission mechanism S, the funicular member 79) is held by the housing 50 also in this embodiment, similar effect as obtained by the embodiments shown in FIGS. 5 and 6 can be obtained.

Figure 13:
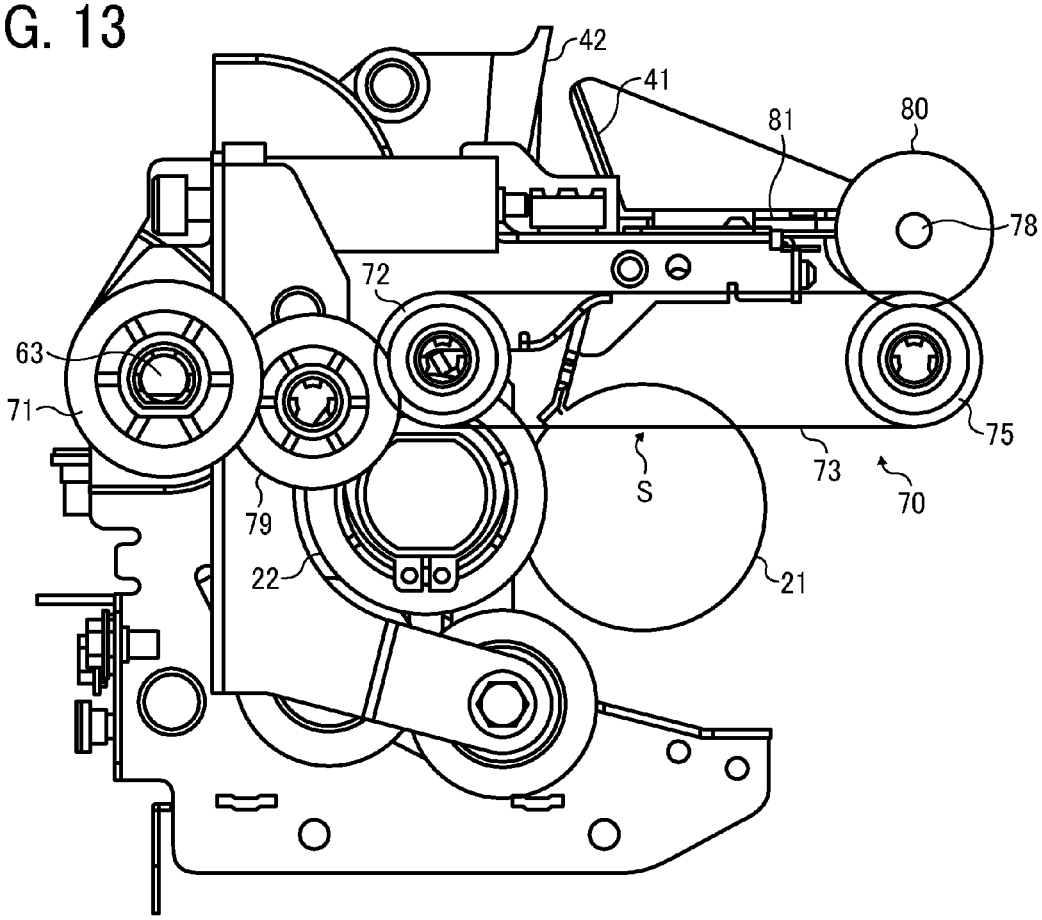
FIG. 13 illustrates a shutter actuator 70 of yet another embodiment of the present invention.
Figure 14:
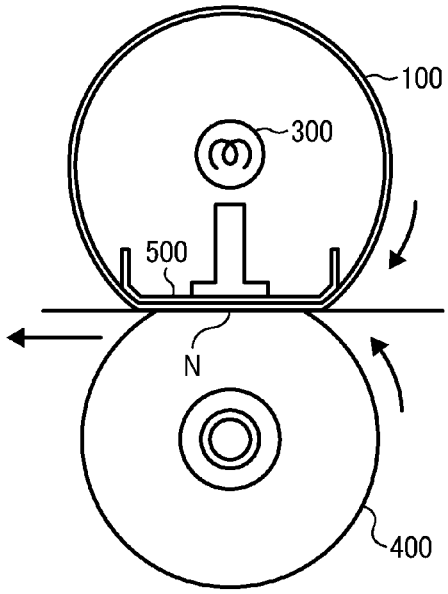
FIG. 14 is a cross-sectional view illustrating a schematic configuration of a conventional fixing device.

FIG. 13 illustrates a shutter actuator 70 of yet another embodiment of the present invention. This shutter actuator is different from that of the embodiments shown in FIGS. 5 and 6 by that the idler gear 79 is disposed between the second driving gear 71 of the driving shaft 63 and the driving pulley 72, and an output of the driven pulley 75 is transmitted to the driven shaft 78 via a gear 80 meshing with a gear section of the driven shaft 78. Further, driving power is directly inputted from a rotation driving source disposed in the apparatus body to the second driving gear 71. Accordingly, the first driving gear 64 shown in FIG. 3 is omitted. Although it is not shown, but a roller driving cam 65 (see, FIGS. 3 and 4) is attached to the driving shaft 63. A shutter driving cam 77 (see, FIGS. 5 and 6) is also attached to the driven shaft 78.

With such a configuration, a belt transmission system composed of the driving pulley 72, the driven pulley 72, and the belt 73 does not include an upwardly bending portion. Thus, the number of pulleys can be more decreased when compared with the embodiments shown in FIGS. 5 and 6 while simplifying the shutter actuator 70 and omitting a space.

As described above, the exemplary shutter drive mechanism 70 uses the gear and the belt transmission system at the same time. However, the shutter drive mechanism 70 can be constituted only by one of the gear and the belt transmission system. Further, the shutter drive mechanism 70 can be wholly or partially constituted by a linkage.

Further, an optional configuration can be employed for the engagement-disengagement mechanism 60, and various known mechanisms can be adopted. Heretofore, in the above-described embodiments, sliding movement of the shutter 81 and the pressing roller 22 is achieved by the cams 65 and 77 as one example. However, such a moving mechanism can be replaced with the other mechanism, such as a linkage, etc.

The present invention is not limited to the above-described fixing device having the thin fixing belt of the small diameter for the purpose of improving energy saving as in the above-described various embodiments, and can be applied to the IH type as shown in FIG. 9 and widely known fixing devices. Further, the fixing device of the present invention is not limited to the color laser printer as shown in FIG. 1, and can be installed in a black-and-white image forming apparatus, and other printer, copiers, facsimiles, and multifunctional devices or the like.

According to one embodiment of the present invention, since the shutter is closed when a fixing operation is not executed on one hand, while is open to allow passage of a sheet when the fixing operation is executed on the other hand, heat radiation from the fixing device can be suppressed improving thermal insulation.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a rotatable fixing member to heat a side of a recording medium, the side bearing an unfixed image;

a heat source to heat the rotatable fixing member;

a rotatable pressing member disposed opposite the fixing member to press against the fixing member and form a nip on the fixing member;

a housing to accommodate at least the fixing member and the pressing member;

a conveyance path defined internally within the fixing device to convey a recording medium therethrough and between the fixing member and the pressing member;

at least one shutter disposed on one of upstream and downstream sides of the nip;

a shutter actuator to move the at least one shutter to open and close the conveyance path; and an engagement-disengagement unit to contact and separate the fixing member to and from the pressing member to form and cancel the nip, wherein the shutter actuator is linked with the engagement-disengagement unit and wherein the housing holds the at least one shutter and the shutter actuator.

2. The fixing device as claimed in claim 1, wherein the shutter actuator comprises:

an input side member powered by the engagement-disengagement unit;

an output side member to drive the shutter; and a transmission mechanism to transmit the power from the input side member to the output side member.

3. The fixing device as claimed in claim 2, wherein the output side member employs a cam.

4. The fixing device as claimed in claim 1, wherein an operation timing of the engagement-disengagement unit is changed with ambient temperature.

5. The fixing device as claimed in claim 1, wherein the shutter is located downstream of the nip.

6. The fixing device as claimed in claim 1, wherein the at least one shutter comprises a thermal insulation member on its nip side surface.

7. The fixing device as claimed in claim 1, wherein the at least one shutter slides in a prescribed direction.

8. The fixing device as claimed in claim 7, wherein the housing guides the at least one shutter as the at least one shutter slides between open and closed positions.

9. An image forming apparatus comprising:

an image forming unit to for a toner image; and the fixing device of claim 1.

10. The image forming apparatus as claimed in claim 9, wherein the shutter actuator comprises:

an input side member powered by the engagement-disengagement unit;

an output side member to drive the shutter; and a transmission mechanism to transmit the power from the input side member to the output side member.

11. The image forming apparatus as claimed in claim 10, wherein the output side member employs a cam.

12. The image forming apparatus as claimed in claim 9, wherein the at least one shutter is located downstream of the nip.

13. A fixing device comprising:

a rotatable fixing member to heat a side of a recording medium, the side bearing an unfixed image;

a heat source to heat the rotatable fixing member;

a rotatable pressing member disposed opposite the fixing member to press against the fixing member and form a nip on the fixing member;

a housing to accommodate at least the fixing member and the pressing member;

a conveyance path defined internally within the fixing device to convey a recording medium therethrough and between the fixing member and the pressing member;

at least one shutter disposed on one of upstream and downstream sides of the nip, wherein the at least one shutter is located downstream of the nip; and a shutter actuator to move the at least one shutter to open and close the conveyance path; and wherein the housing holds the at least one shutter and the shutter actuator and wherein the housing comprises:

a first guide to guide a fixing member side surface of the recording medium passing through the nip; and a separator to separate the recording medium from the fixing member, wherein the at least one shutter is disposed between the first guide and the separator.

14. The fixing device as claimed in claim 13, further comprising:

an elastically deformable seal attached to the at least one shutter, wherein the housing further includes a second guide to guide the recording medium passing through the nip, and wherein the at least one shutter is pressed against the second guide via the seal.

15. An image forming apparatus comprising:

an image forming unit to for a toner image; and the fixing device of claim 13.

16. The image forming apparatus as claimed in claim 15, further comprising:

an elastically deformable seal attached to the shutter, wherein the housing further includes a second guide to guide the recording medium passing through the nip, and wherein the at least one shutter is pressed against the second guide via the seal.

17. A fixing device comprising:

a rotatable fixing member to heat a side of a recording medium, the side bearing an unfixed image;

a heat source to heat the rotatable fixing member;

a rotatable pressing member disposed opposite the fixing member to press against the fixing member and form a nip on the fixing member;

a housing to accommodate at least the fixing member and the pressing member;

a conveyance path defined internally within the fixing device to convey a recording medium therethrough and between the fixing member and the pressing member;

at least one shutter disposed on one of upstream and downstream sides of the nip, wherein the at least one shutter is located downstream of the nip;

a shutter actuator to move the at least one shutter to open and close the conveyance path; and wherein the housing holds the at least one shutter and the shutter actuator and wherein the at least one shutter has an area of reduced friction where the at least one shutter contacts the recording medium.

18. An image forming apparatus comprising:

an image forming unit to for a toner image; and the fixing device of claim 17.

19. A fixing device comprising:

means for heating a recording medium and fixing an unfixed image thereon;

means for generating and conveying heat to the heating means;

means for pressing against the heating means and forming a nip thereon;

means for accommodating at least the heating means and the pressing means;

means for conveying a recording medium along a conveyance path in the fixing device;

means for opening and closing the conveyance path on one of upstream and downstream sides of the nip, wherein the means for opening and closing the conveyance path is located downstream of the nip;

means for moving the means for opening and closing to open and close the conveyance path; and means for contacting and separating the means for heating and fixing to and from the means for pressing to form and cancel the nip, wherein the means for moving is linked with the means for contacting and separating and wherein the accommodating means hold the opening and closing means.

20. An image forming apparatus comprising:

an image forming unit to for a toner image; and the fixing device of claim 19.

* * * * *